US011828009B2

(12) United States Patent
Huffa et al.

(10) Patent No.: US 11,828,009 B2
(45) Date of Patent: Nov. 28, 2023

(54) SYSTEM AND METHOD OF UNSPOOLING A MATERIAL INTO A TEXTILE MACHINE

(71) Applicant: Fabdesigns, Inc., Malibu, CA (US)

(72) Inventors: Bruce Huffa, Encino, CA (US); Concetta Maria Huffa, Encino, CA (US)

(73) Assignee: FABDESIGNS, INC., Malibu, CA (US)

( * ) Notice: Subject to any disclaimer, the term of this patent is extended or adjusted under 35 U.S.C. 154(b) by 291 days.

(21) Appl. No.: 16/413,405

(22) Filed: May 15, 2019

(65) Prior Publication Data

US 2019/0352816 A1 Nov. 21, 2019

Related U.S. Application Data

(60) Provisional application No. 62/672,519, filed on May 16, 2018.

(51) Int. Cl.
*D04B 15/48* (2006.01)
*B65H 49/20* (2006.01)
(Continued)

(52) U.S. Cl.
CPC ..... *D04B 15/48* (2013.01); *B65H 49/20* (2013.01); *B65H 59/02* (2013.01); *B65H 59/04* (2013.01);
(Continued)

(58) Field of Classification Search
CPC ..... D04B 15/48; D04B 15/44; D04B 15/99; D04B 15/46; B65H 49/20; B65H 49/02;
(Continued)

(56) References Cited

U.S. PATENT DOCUMENTS 1,712,344 A 5/1929 Graeber
1,828,533 A 10/1931 Hoffmann
(Continued)

FOREIGN PATENT DOCUMENTS

DE 3937406 5/1991
DE 4439907 5/1996
(Continued)

OTHER PUBLICATIONS

EP1298239 (Year: 2003).*
(Continued)

*Primary Examiner* — Danny Worrell
*Assistant Examiner* — Dakota Marin
(74) *Attorney, Agent, or Firm* — GARSON & GUTIERREZ, PC

(57) ABSTRACT

An automated unspooling mechanism capable of dispensing of knitting material strands in a dynamically-controlled tension on a knitting machine. An unspooling device is configured to sense the tension of a strand fed to the knitting machine, and responsively adjust the strand deployment speed to avoid too little or too much strand dispensing without interrupting the knitting process. The unspooling device includes a variable motor drive that can rotate the strand package in various speeds, and a spring arm trigger that can sense the current tension of the dispensed material. The spring arm trigger can vary its arm position based on the sensed tension. The arm position is then processed and converted to a signal to vary the motor speed. Therefore, the deployment speed of the strands can be dynamically controlled based on a sensed tension of feeding the strand.

21 Claims, 16 Drawing Sheets

(51) Int. Cl.

| | |
|---|---|
| ***B65H 59/02*** | (2006.01) |
| ***D04B 15/44*** | (2006.01) |
| ***D04B 15/99*** | (2006.01) |
| ***B65H 59/04*** | (2006.01) |
| ***B65H 59/38*** | (2006.01) |
| *D04B 15/46* | (2006.01) |

(52) U.S. Cl.
CPC ..... *B65H 59/387* (2013.01); *D04B 15/44* (2013.01); *D04B 15/99* (2013.01); *B65H 59/385* (2013.01); *D04B 15/46* (2013.01)

(58) Field of Classification Search
CPC ..... B65H 59/04; B65H 59/387; B65H 59/02; B65H 59/385
USPC ..... 66/146
See application file for complete search history.

(56) References Cited

U.S. PATENT DOCUMENTS

| | | | | |
|---|---|---|---|---|
| 2,294,916 | A | 9/1942 | Kretser | |
| RE24,737 | E | 11/1959 | Bolles et al. | |
| 3,733,856 | A | 5/1973 | Masahiro | |
| 3,859,824 | A | 1/1975 | Krylov et al. | |
| 3,992,903 | A | 11/1976 | Janda et al. | |
| 4,122,555 | A | 10/1978 | Safrit et al. | |
| 4,237,706 | A | 12/1980 | Patthey | |
| 4,426,856 | A * | 1/1984 | Winter | B65H 61/00 66/212 |
| 4,660,783 | A * | 4/1987 | Roser | B65H 59/18 242/155 R |
| 4,669,677 | A * | 6/1987 | Roser | D04B 15/48 242/366.1 |
| 4,706,476 | A * | 11/1987 | Memminger | D04B 15/99 66/132 R |
| 4,748,078 | A | 5/1988 | Doi et al. | |
| 4,752,044 | A * | 6/1988 | Memminger | D04B 15/48 242/365.7 |
| 5,069,395 | A * | 12/1991 | Krumm | B65H 59/387 242/364.7 |
| 5,517,832 | A | 5/1996 | Kristensen | |
| 5,615,562 | A | 4/1997 | Roell | |
| 5,740,974 | A * | 4/1998 | Conzelmann | D04B 15/482 242/417 |
| 6,094,945 | A * | 8/2000 | Lonati | D04B 35/12 139/194 |
| 6,832,496 | B2 * | 12/2004 | Tholander | D04B 15/38 66/125 R |
| 6,854,200 | B2 | 2/2005 | Hipp et al. | |
| 6,986,269 | B2 | 1/2006 | Dua | |
| 7,055,349 | B2 * | 6/2006 | Morita | D04B 15/44 66/146 |
| 7,218,988 | B2 * | 5/2007 | Morita | D04B 1/28 66/71 |
| 7,692,393 | B2 * | 4/2010 | Caamano | B65H 75/4484 318/16 |
| 8,382,023 | B2 * | 2/2013 | Barea | D04B 15/48 242/365.7 |
| 8,448,474 | B1 | 5/2013 | Tatler et al. | |
| 8,955,787 | B2 * | 2/2015 | Tanigawa | B65H 59/387 242/439.6 |
| 8,973,410 | B1 | 3/2015 | Podhajny | |
| 9,149,086 | B2 | 10/2015 | Greene et al. | |
| 9,226,540 | B2 | 1/2016 | Podhajny | |
| 9,549,591 | B2 | 1/2017 | Uchikawa et al. | |
| 9,661,892 | B2 | 5/2017 | Meir | |
| 9,688,505 | B2 * | 6/2017 | Yamaguchi | B65H 59/387 |
| 9,771,673 | B2 | 9/2017 | Kenaka et al. | |
| 9,856,106 | B1 * | 1/2018 | Stewart | D04B 15/40 |
| 10,233,574 | B2 | 3/2019 | Wan et al. | |
| 10,294,591 | B2 | 5/2019 | Podhajny et al. | |
| 10,753,019 | B2 | 8/2020 | Berrian et al. | |
| 2005/0224619 | A1 * | 10/2005 | Barea | D04B 15/48 242/365.7 |
| 2007/0022511 | A1 * | 2/2007 | Narasimhan | D04B 1/10 2/159 |
| 2007/0210198 | A1 * | 9/2007 | Huss | D04B 15/48 242/365.2 |
| 2013/0193126 | A1 * | 8/2013 | Anderson | B65H 59/387 219/137.2 |
| 2014/0134378 | A1 | 5/2014 | Downs et al. | |
| 2016/0029736 | A1 | 2/2016 | Meir | |
| 2016/0075061 | A1 | 3/2016 | Waas et al. | |
| 2016/0369436 | A1 | 12/2016 | Stewart et al. | |
| 2017/0176146 | A1 | 6/2017 | Bohringer et al. | |
| 2018/0002133 | A1 | 1/2018 | Stewart et al. | |
| 2018/0055145 | A1 | 3/2018 | Aristizabal et al. | |
| 2018/0184755 | A1 | 7/2018 | Yumiba et al. | |
| 2018/0303204 | A1 | 10/2018 | Woodard | |
| 2018/0343956 | A1 | 12/2018 | Li et al. | |
| 2018/0343973 | A1 | 12/2018 | Hancock | |
| 2019/0153639 | A1 | 5/2019 | Nishigaki | |
| 2019/0203389 | A1 | 7/2019 | Liu | |
| 2019/0231021 | A1 | 8/2019 | Hoying et al. | |
| 2019/0233988 | A1 | 8/2019 | Harada et al. | |
| 2019/0328075 | A1 | 10/2019 | Poulsen et al. | |

FOREIGN PATENT DOCUMENTS

| | | | | |
|---|---|---|---|---|
| EP | 061975 | | 10/1982 | |
| EP | 0526406 | | 2/1993 | |
| EP | 1298239 | | 2/2003 | |
| EP | 1298239 | A1 * | 4/2003 | B65H 59/385 |
| EP | 2960362 | | 12/2013 | |
| EP | 3412814 | | 12/2018 | |
| EP | 3569750 | | 11/2019 | |
| FR | 598096 | | 4/1925 | |
| FR | 2149520 | | 8/1972 | |
| GB | 720687 | | 12/1954 | |
| GB | 2214939 | | 9/1989 | |
| TW | M547866 | U | 1/2017 | |
| WO | WO2010142608 | | 12/2010 | |
| WO | WO2011043998 | | 4/2011 | |
| WO | WO2015134648 | | 9/2015 | |
| WO | WO2016144971 | | 9/2016 | |

OTHER PUBLICATIONS

Gupta, B.S., and M. Afshari, "Tensile Failure of Polyacrylonitrile Fibers." Handbook of Tensile Properties of Textile and Technical Fibres, Woodhead Publishing, Mar. 27, 2014, www.sciencedirect.com/science/article/pii/B978184569387950014X?via%3Dihub. (Year: 2014).

* cited by examiner

PARTS OF A LOOP

SYSTEM AND METHOD OF UNSPOOLING A MATERIAL INTO A TEXTILE MACHINE

CROSS REFERENCE TO RELATED APPLICATION

This patent application claims priority and benefit of U.S. Provisional Patent Application No. 62/672,519, entitled "METHOD FOR UNSPOOLING A FIBER INTO A TEXTILE MACHINE," filed on May 16, 2018, the entire content of which is herein incorporated by reference for all purposes.

TECHNICAL FIELD

Embodiments of the present disclosure relate generally to textile manufacturing machines, and more specifically, to the field of strand unspooling mechanisms on textile manufacturing machines.

BACKGROUND OF THE INVENTION

Most textile equipment is used for traditional textile manufacturing applications, such as apparel, and utilizes traditional yarns such as cotton, wool, polyester, nylon, elastics, and other common materials. OEM textile equipment is generally engineered to support the apparel industry. Modern textile machines, such as electronic knitting equipment, have variable speed motors driving the fabric making process. This is true for circular knitting machines, warp knitting machines, flat knitting machines, certain braiding and webbing machines. Flat V-bed knitting machines create unique challenges. Particularly, when feeding traditional materials into a flat V-bed machine in a knitting process, selected feeders may travel different distances on each traverse of the machine, may remain static for some periods of time in the knitting process, may start abruptly or come to sudden halts. Knitting materials (e.g., yarns or strands) are wound or otherwise packaged on spools, flanged cores or other cylindrical packaging, which stand on end according to the OEM standard feed configuration.

When they are deployed and fed to the machine for knitting, the materials tend to over spin, snag on flanges, and slide over itself. Standard machine builder package holders or spindles hold the cylinder-shaped packages on their ends and deploy the materials. For example, a holder or spindle pulls a yarn up one end where it spirals on itself, adding twist to the material. This twist builds up as the material is deployed and creates a hard spot, containing excess twist in one section, typically resulting in the material work-hardening and breaking on itself. When the machine stops, the cylinder continues to spin and the slack slides over itself, which can cause tanglement when the feed starts again. The same packages, if mounted on a slanted or level horizontal spindle that is perpendicular to the machine as in circular stands or creels, pose the same torqueing problem. Slanting the perpendicular spindles (package holders) adds to the tangling problem, with the materials sliding over themselves.

Slick materials (such as monofilaments and wires) slide down the spools over other wrapped strands of material, which usually causes a snag on the spool and stops the deployment of material. The material may break at the needle in the machine or at the spool. Conversely, strong materials can break machine parts, guides and needles, and stop motions.

Mounting the packages horizontal and parallel to the machine solves the torqueing problem, but this makes the packages difficult to start spinning during operation. Sudden starts can break the material, sudden stops cause the issues of: an undesired unraveling; loose strands; tangling the material on the packaging; potential snagging on other parts of the equipment; loose material (slack) not wound back on to the spool; slack in the strand causing loose rows to be knitted in the next or several next fabric rows and resulting in inconsistent fabrication. Conversely, restarting the cylindrical packaging in order to deploy material again after a machine stop or feeder pause can create tight rows in the next or several next fabric rows, resulting in inconsistent knitting. The row may be so tight as to break at the knitting needle, perhaps even break the needle. Once a break has occurred in a material such a filament, there is no way to repair the knitted construction without producing an obvious defect. The machine must be stopped, the end of the tangled mess found on the cylinder package must be located and restrung throughout the machine, which is a frustrating process.

This is particularly true of monofilaments, multi-filaments, carbon fiber constructions, fiber glass, filament wires, cables, fiber optics, silicon, rubber, elastics, chain, cord, cable, fiber reinforcement materials for composites, stiff materials, fishing line, and other slick or shiny materials. The knitting process must be restarted again. The existing workpiece has to be discarded, no matter where it is currently in the knitting process. There can be minutes, hours, or in the case of some composite materials, days already invested into the knitting process, as well as expensive materials.

Precisely controlled unspooling is particularly important when controlled amounts of material must be incorporated into a fabrication. Most existing unspooling tensioning devices apply torque to the cylinder-shaped package and spindle on which the package or the spool is mounted, thereby allowing the material to be deployed constantly as a positive feed. However, this is problematic on textile equipment, specifically weft knitting or V-bed machines. The main reason is that the belt drive systems move feeders only where there is knitting operation occurring, and thus the feeders start/stop suddenly. Starting a feeder can be a jerky motion, which is difficult for positive feed systems to manage precisely.

For typical yarn constructions on standard packaging on a knitting machine, standard spindle positioning is used on the machine, and the machine is designed to keep this erratic motion by using an electronic stop motion system. FIG. 1 illustrates a knitting machine. FIG. 2 illustrates a right view of an OEM stop motion assembly (or herein "stop motion" for brevity) on the knitting machine. FIG. 3 illustrates a top view of the OEM stop motion. FIG. 4 illustrates a left view OEM stop motion. FIG. 5 illustrates a bottom view of the OEM stop motion. FIG. 6 illustrates the front view of the OEM stop motion.

As illustrated, the stop motion system has a metal (or metalized) spring tension arm 7 with an eyelet 9 at the end to thread material strands 9. When there is too much slack (tension is too low) on the material strand or the material breaks, the metalized spring arm 7 raises to meet an electrified wire inside the housing to create a circuit that stops the machine abruptly. This spring arm action halts materials being pulled and the entire knitting process. The spring arm action is activated if the strand breaks.

A secondary mechanical action occurs with either of two metal strips 10 that ride along the strand in the stop motion assembly and are triggered by linear irregularity in the material, or in the case if there is a knot sensed in the cymbal guides 11, or in one of several manual tensioning devices 12 on the stop motion assembly. As long as a minimum tension is continuously applied to the material feeding through the machine, and there are no sensed linear defects, the stop sensors will not be activated. The tensions in most stop motion assemblies are adjustable thought a series of mechanical spring-loaded dials that put torque tension on the spring arm 7, the manual tensioning devises 12, and the sensitivity of the knot catchers 10.

FIG. 3 demonstrates a stop motions system mounted on a standard OEM machine bar 13 above the machine body. As in FIG. 4, the OEM bar 13 has a groove in it where an OEM cable 14 is housed, connecting all the electronic stop motion components to the machine's controller and power. FIG. 5 demonstrates a bottom view of a strand as it passes through the various guides 6, cymbals 11, and tensioning devices 12 of a standard OEM stop motion assembly. For conductive materials such as carbon fibers, copper wires, and stainless-steel fibers for example, friction is created each time a material interfaces with a surface of a standard OEM stop motion. Except for the pot eye 8 at the end of the deployment tensioning arm 7, each guide 6 and tensioning device 12 is made of conductive metal. FIG. 6 shows a front view of the OEM stop motion assembly mounted on the standard OEM bar 13, with a strand 9 passing through the various guides 6 and tensioning devices 12, including a fully bowed deployment tensioning arm 15. The angles required of a stiff or conductive material to pass through a standard OEM stop motion increase drag, risk of conductive charge build up, and the risk that a material may build a shape memory from the passages. Certain materials such as carbon fiber would break off a significant amount of fibers if required to pass through these right and acute angles of a standard OEM stop motion. Abrasive materials such as ceramics, meta-aramids, and para-aramids for example, would create excessive wear on many of the guides, tensioning devices, and the pot eye.

In a majority of flat knitting or V-bed machines currently on the market, for example: a Stoll CMS 530 HP electronic knitting machine, or a Shima Seiki SRY123lp, or a Cixing HP2-45, or one of many other similarly laid out flat-knitting machine makes and models, which have the standard OEM stop motions mounted atop the machine as in FIG. 1, the yarns traverse from the material package unit 1, through one of several yarn guide eyes 6, into a stop motion assembly 5 at the top of the machine, then diagonally to one of either side of the machine, to an eyelet 16 or yarn positive feed system 17 mounted at the end of the machine. The strand then travels down into the end of the machine into the eyelet 16 below the yarn storage feed system and into a pot eye mounted on a spring tensioning arm 18 mounted on the end of the machine. The side tensioning devices are also part of the electronic stop motion assembly of the machine. The strand then passes at a ninety-degree angle into the side of the machine, traversing one of several feed rails 19 through a guide eyelet on the feed rail and through another angled eyelet on the yarn feeder 3 and down into a tube in the yarn feeder tip. The end of the strand is thereby tensioned and secured ready for the knitting process. The material is then inserted in the "weft" or horizontal direction.

The term "V-bed" or "flat-bed weft knitting" is used to describe the construction of fabric by feeding yarn and forming loops in the horizontal ("weft") direction. FIG. 7 illustrates the stitches formed in weft knitting. FIG. 8 illustrates a side view of two needle beds on a V-bed knitting machine. The two needle beds are positioned at an angle resembling a letter "V." Each bed 20 has a set of needles 21. In the case of four needle bed machines. FIG. 9 illustrates a side view of four needle beds on a weft knitting machine. Two of he four needle beds are positioned at an angle resembling a letter "V," and the other two are auxiliary or alternate beds 22. There are fashioning points 23 or additional needles that allow relocating stitches from the V-beds to another location or adding additional stitches.

FIG. 10 illustrates a side view of a weft knitting machine with a produced fabric exiting from the machine. In weft knitting, loops are progressively built up in a fabric by converting the new yarn 9 being fed into in the needle hooks 21, into new rows of loops ("courses"), where each stitch is a wale (as shown in FIG. 7). The rows of wales are pushed down by the sinkers on the edge of the needle bed, which are activated mechanically, by the cam box of the machine traveling across the needle bed and digitally selecting needles for action.

Yarn 9 is fed into the machine by automatically. As shown in FIG. 10, a plurality of strands of yarns 24 or other materials are pulled off a plurality of spools/packages 1 with the movement of the knitting machine feeders 3 on the feeder rails 25. Multiple strands 24 may be inserted into one feeder 3 or a single strand 9, made be inserted into one feeder. Each strand should ideally travel through its own stop motion for breakage and irregularity detection. The resulting fabric structure 27 is built up under the needle beds 20. Specialized materials such as fiber reinforced polymer strands, stainless steel, silicon, chain, metals, and other materials that must be packaged on a spool, and 'unwound' off that package not to cause torque and ballooning 4 are fed into the machine feeder system by the automatic unspooling device 26.

FIG. 11 illustrates a side view of a V-bed knitting machine with multiple unspooling devices mounted on top. A plurality of these unspooling devices may be mounted on one knitting machine, driving a plurality of strands of natural fibers, metalized, wires, chain, silicon, elasticated, synthetic and other traditional fibers, as well as fiber reinforced polymer polymers ("FPR"), including hemp, flax, linen, glass, basalt, and carbon fiber or other special materials off a plurality of flanged spools 28 and/or cylindrical packages, using variable motors and an electronic stop motion system with a tensioning spring arm sensor (or spring tension trigger arm) 29 in coordination with the movement of the knitting machine feeder 3 system. Moving along the yarn feed rails 25, and the pulled yarn knitting a plurality courses to produce rows of fabric 27. The fabric may be shaped into a two or three-dimensionally knitted component by the pattern program stored in the knitting machine memory.

FIG. 12 illustrates a spacer fabric and warp structures. For example, the knitted structure configuration, utilizing the unspooled material may be knitted as a spacer configuration 30 which is a fabric having a single faced fabric 31 made on one bed and a reverse single faced fabric 31 made on the opposing V-bed. The two single fabrics are connected by an internal strand 32 or combination of internal strands configured in "V" or "X" interlacing patterns. The two face fabrics are connected by tucking or knitting selected needles on each bed. The frequency and configuration of the "V," "X," "W" or other interlacing pattern correlates with the space variation characteristics between the face fabrics, otherwise known as cushioning. The unspooled material may form one or more components of the spacer. There also may be reinforcement strands, inlaid vertically, horizontally, diagonally, or any combination of directions, and moving from one face to the other or reside internally on an interior reverse face of either face fabric.

Several strands may be grouped together in a warp structure. These groups may knit, tuck, inlay or plait or in any combination of structures and in any combination of directions. They may travel asymmetrically 32, in separate groups with differing structures 33, in overlapping group structures 34.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

SUMMARY OF THE INVENTION

Figure 1:
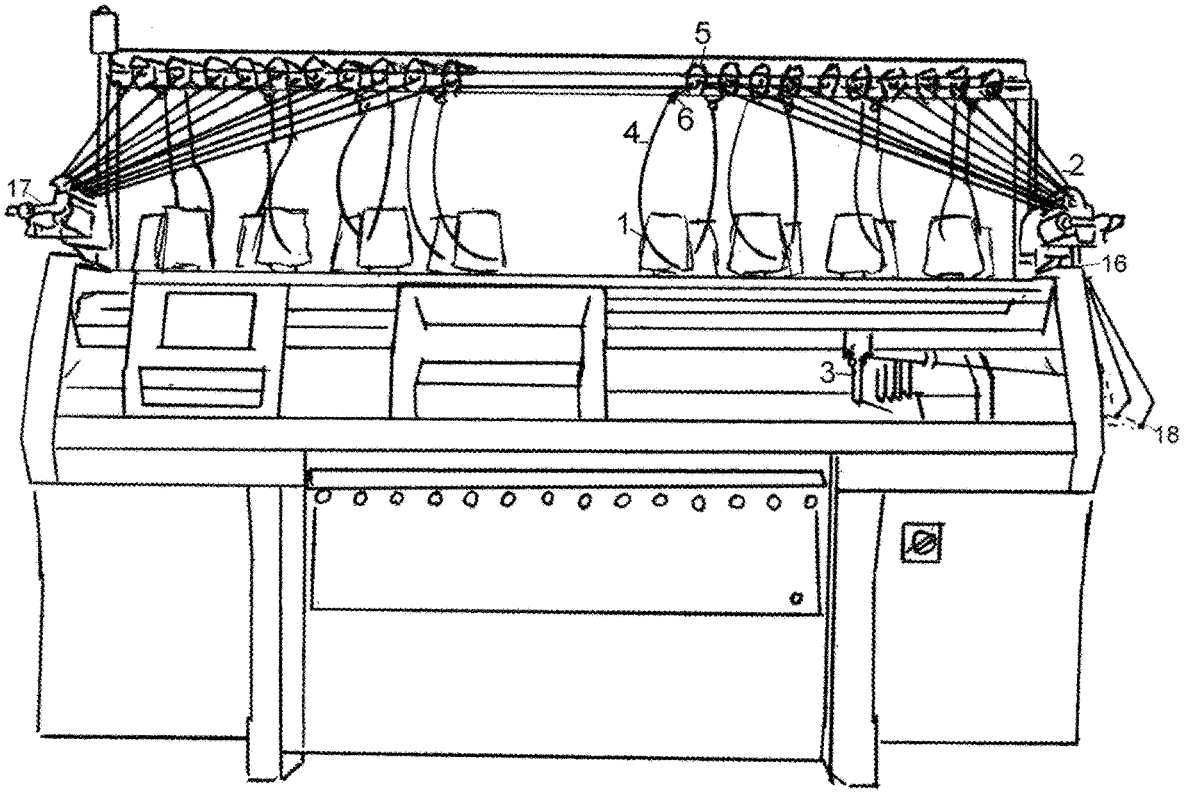
FIG. 1 illustrates a knitting machine equipped with exemplary unspooling devices in accordance with an embodiment of the present disclosure.
Figure 2:
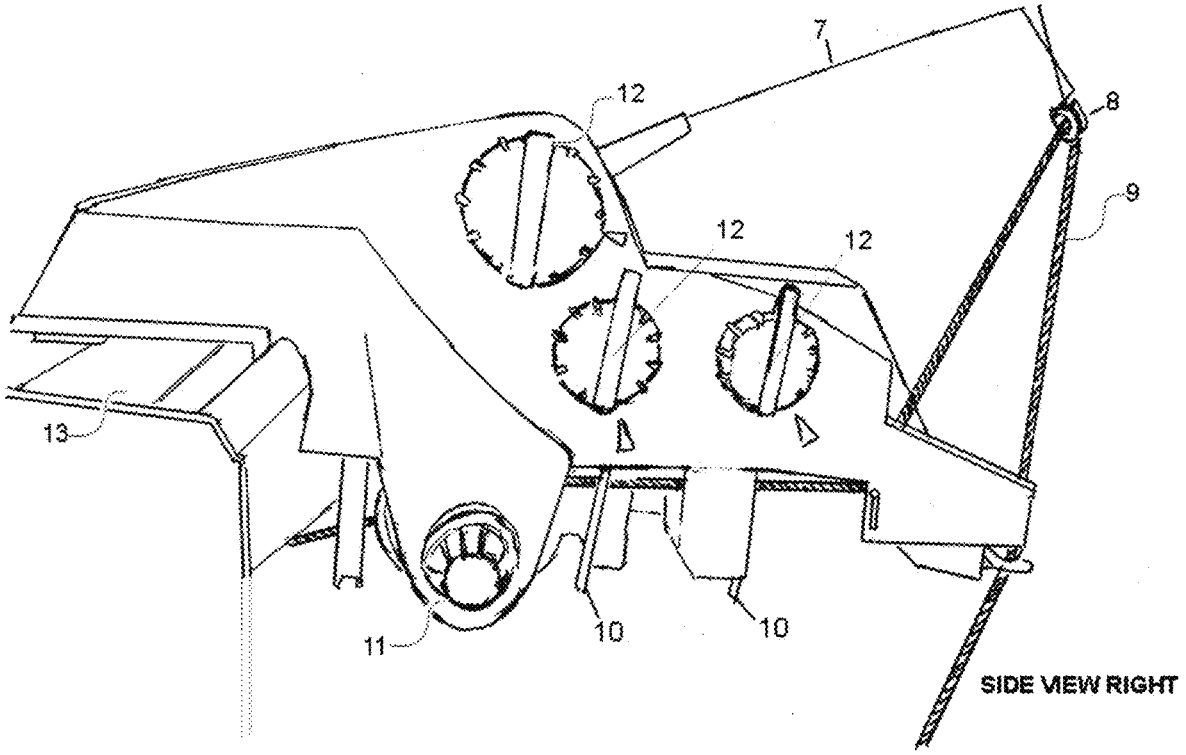
FIG. 2 illustrates a right view of an original equipment manufacturer (OEM) stop motion assembly on the knitting machine.
Figure 3:
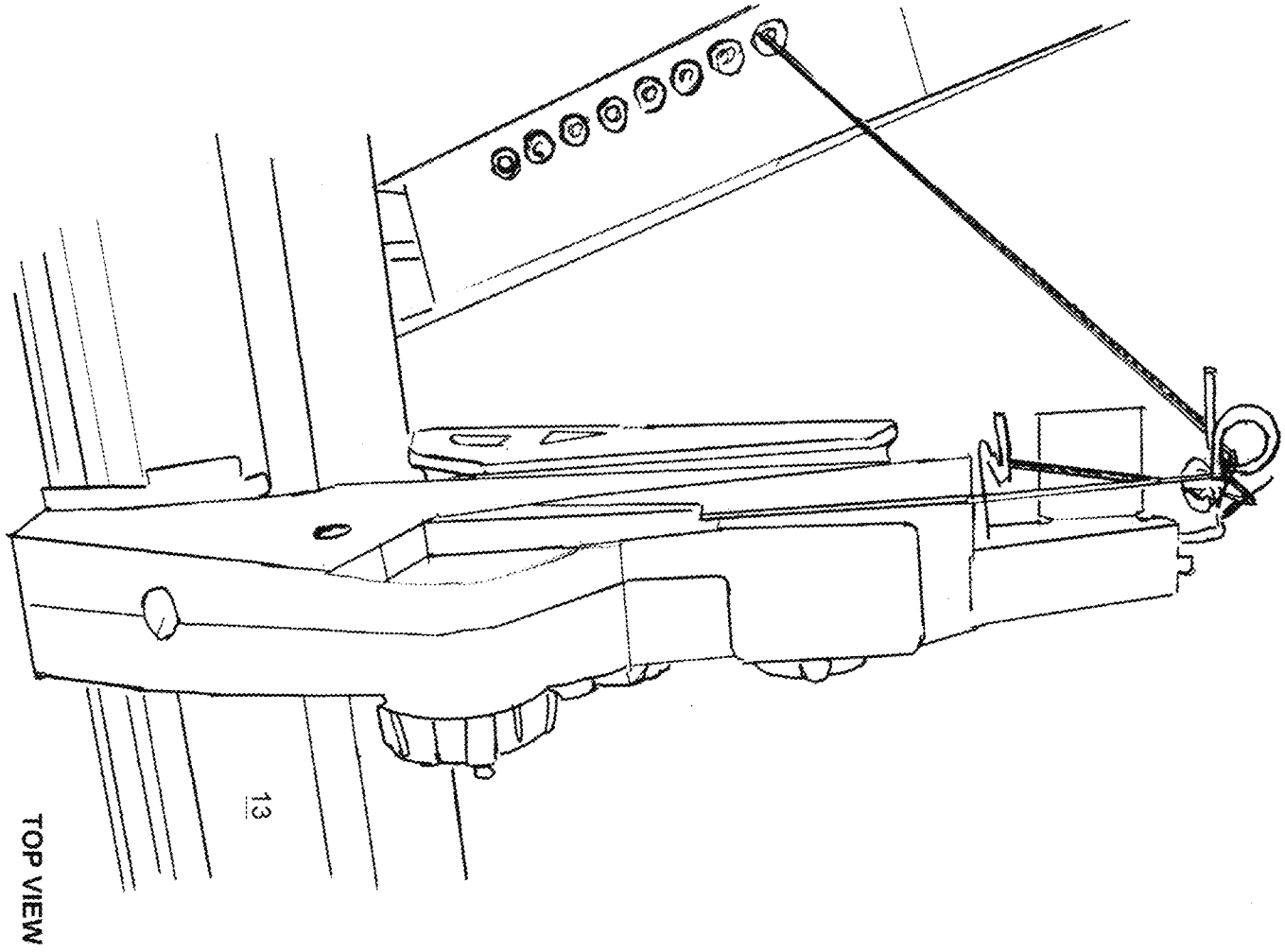
FIG. 3 illustrates a top view of the OEM stop motion.
Figure 4:
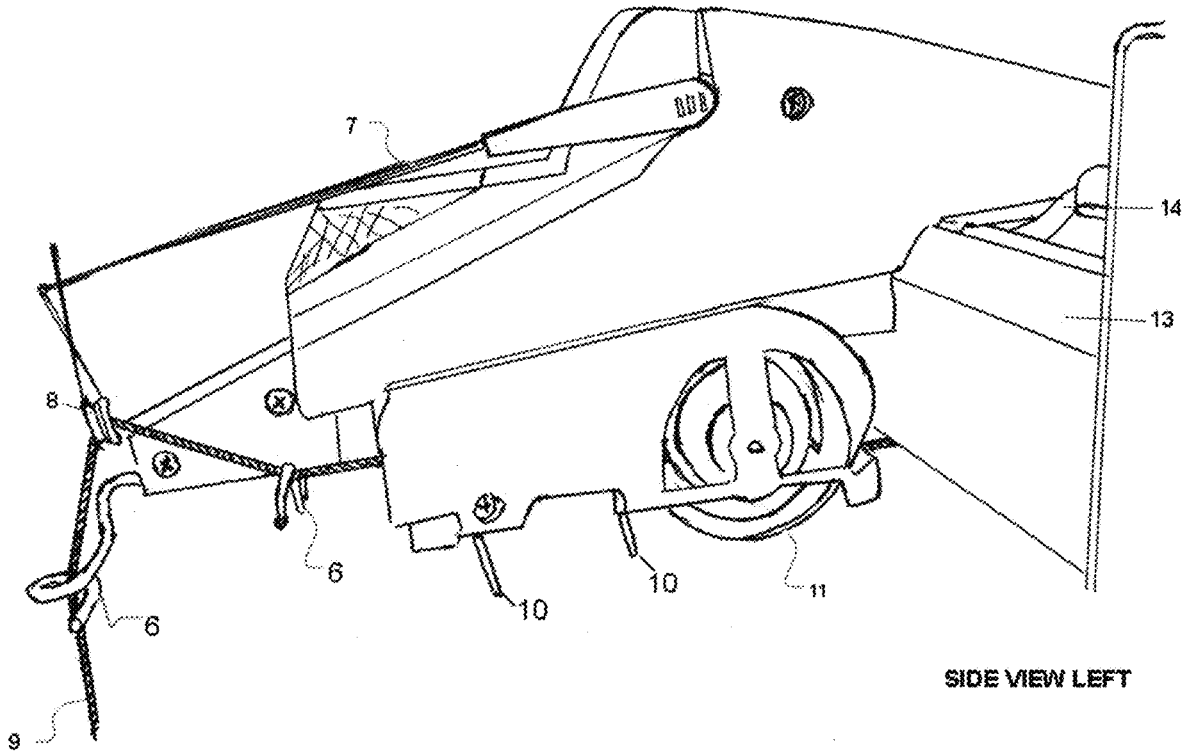
FIG. 4 illustrates a left view OEM stop motion.
Figure 5:
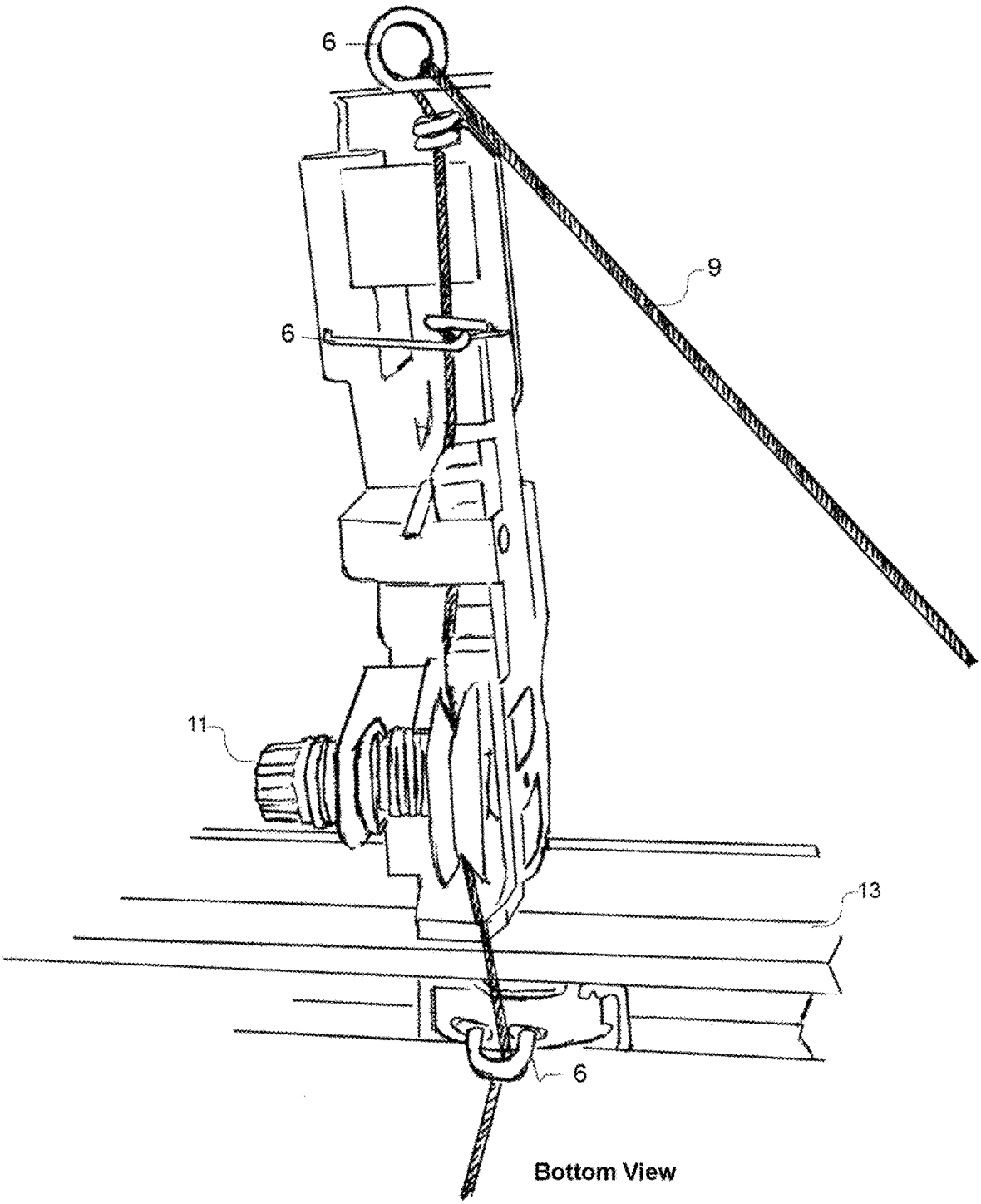
FIG. 5 illustrates a bottom view of the OEM stop motion.
Figure 6:
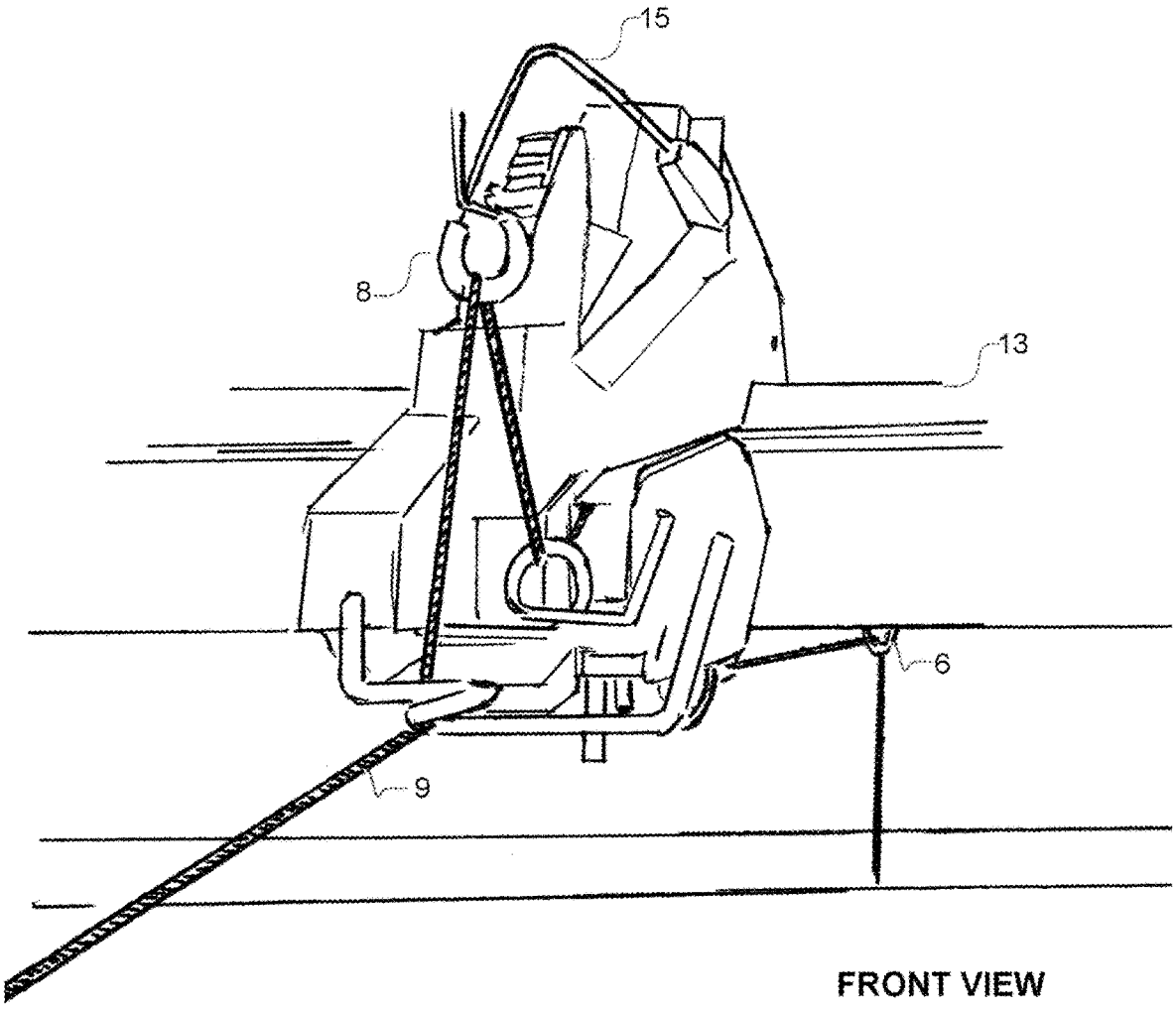
FIG. 6 illustrates the front view of the OEM stop motion.
Figure 7:
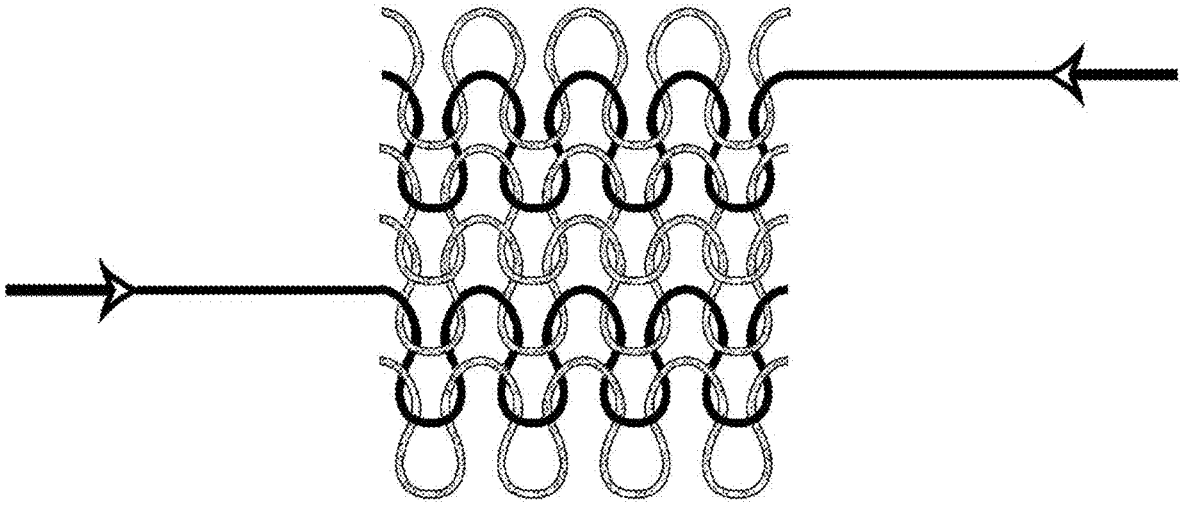
FIG. 7 illustrates the stitches formed in weft knitting.
Figure 8:
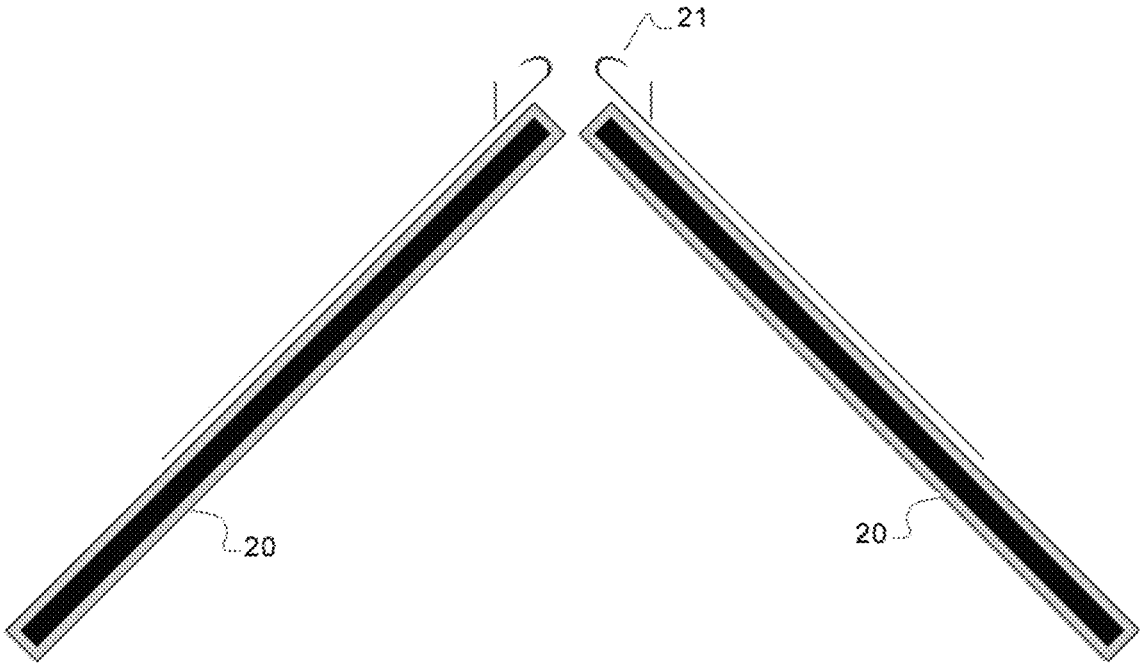
FIG. 8 illustrates a side view of two needle beds on a V-bed knitting machine.
Figure 9:
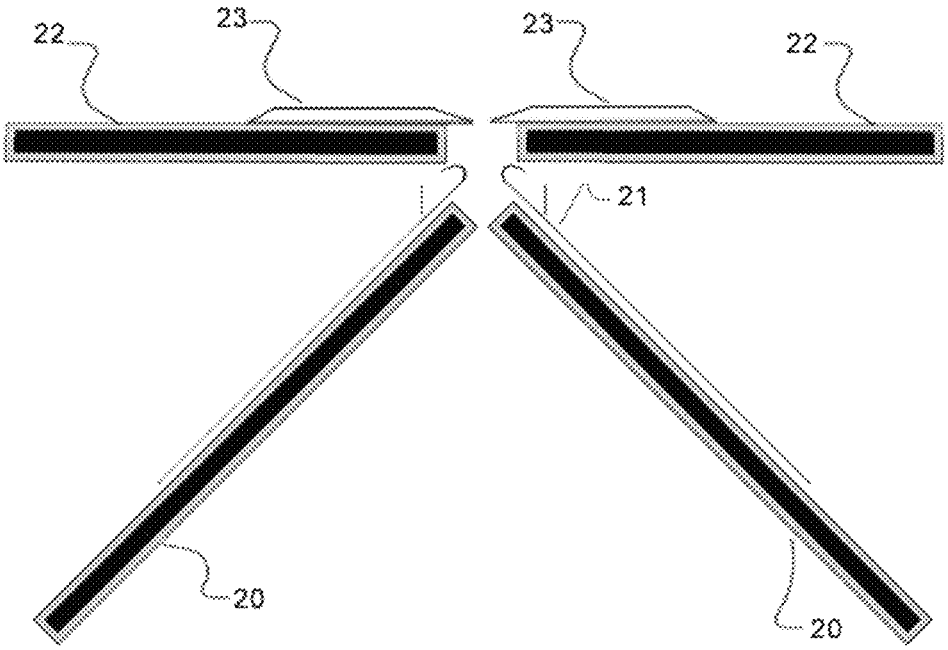
FIG. 9 illustrates a side view of four needle beds on a weft knitting machine.
Figure 10:
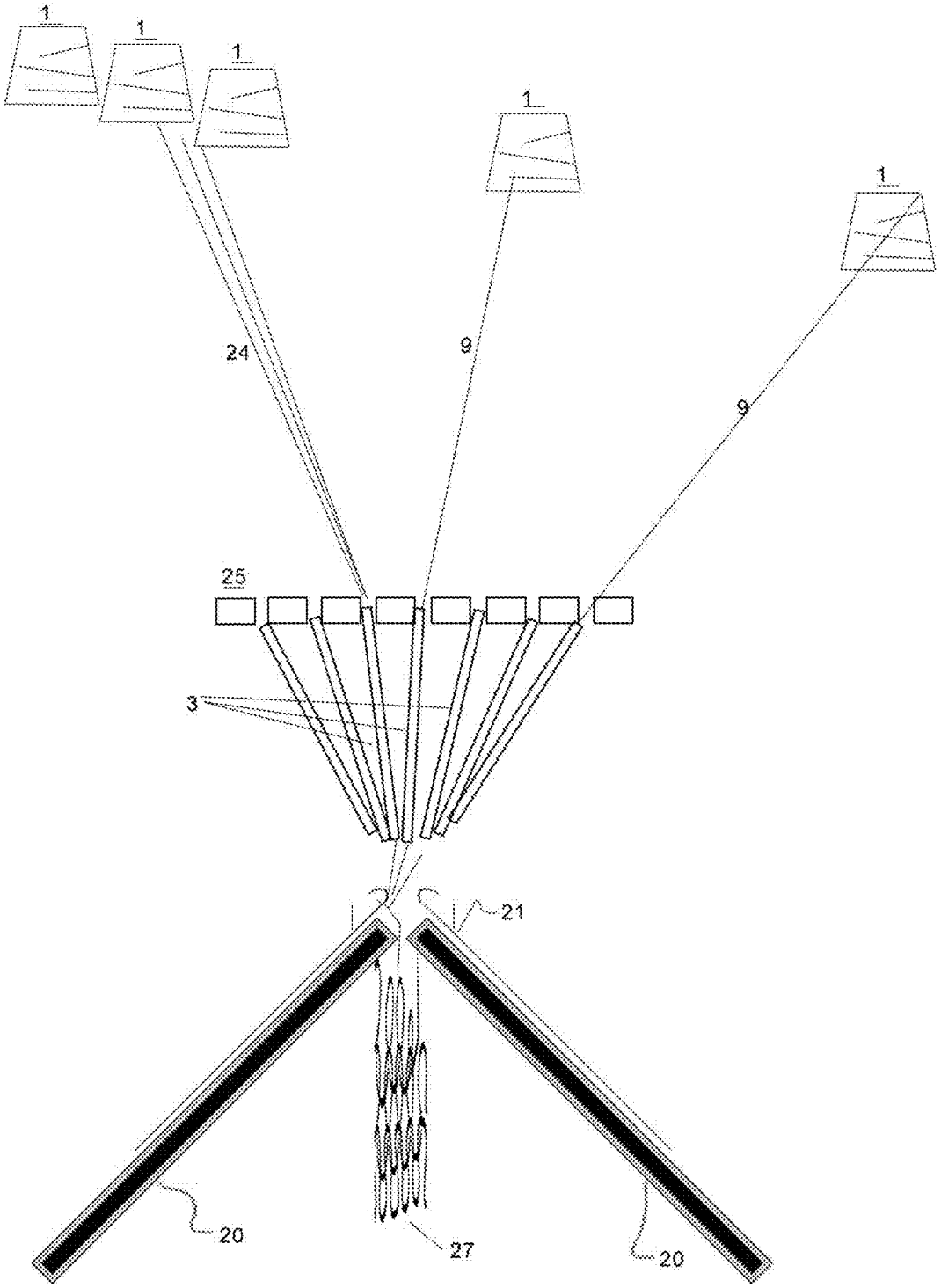
FIG. 10 illustrates a side view of a weft knitting machine with a produced fabric exiting from the machine.

Embodiments of the present disclosure provide an automated unspooling mechanism on a textile machine that includes a feed device capable of controlling the tension of the knitting material and creating a variable deployment speed by which the material is unspooled from a cylinder-shaped package.

Embodiments of the present disclosure provide a unspooling mechanism for a specialized and non-traditional material from a package at graduating speeds of deployment, avoiding the release of too much or too little material that would occur in abrupt deployment, while also preventing the material from torqueing on itself during deployment. The knitting machine can be stopped by a metal deployment arm and arm guide, which flexes and bows with the increased and decreased resistance of drag and friction of deploying yarn from a package. When the arc of the deployment arm reaches a designated obtuse angle and touches a contact point on the stop motion, it creates a closed circuit to send a signal to the machine controller to stop the machine. Additionally, a magnetic motor system (e.g., a step motor, or other such variable motor) is used to slow or speed the deployment of material from a spool package in relation to the speed of the knitting machines. The metal deployment arm is used to create a physical sensor, which is connected to a PCB with an Arduino configuration. A control program is configured to rapidly control and vary the speed of the motor of the unspooling device corresponding to the machine speed. In turn, the speed of deployment of the material from the spool is controlled corresponding to the machine speed. An independent variable motor can stop the machine if too much or too little material is deployed from the material spool, advantageously preventing interruption in the knitting process or inconsistent knitting quality. Interchangeable rollers, pot eyes, and strand guides with engineered surfaces are used to control friction and drag of various types of high-performance, conductive, abrasive, and specialized materials fed into the knitting machine.

Embodiments of the present disclosure allow easy unspooling of conductive wires, silicon, fiber optics, carbon fiber or other fiber reinforcing materials to become one or more parts of the spacer construction, incorporated consistently and repeated automatically in production with controlled deployment of speed and tension into the machine's yarn feed system. Without the limit of two OEM unspooling devices mounted on the floor next to the knitting machines, as available from the current knitting machines, embodiments of the present disclosure allow mounting of multiple unspooling devices on the OEM bar 13, used for OEM stop motions 5, and integrating into the OEM stop motion system by utilizing the OEM stop motion wiring system 14.

Additional mounting bars may be added to the OEM machine, allowing for as many unspooling devices as there are available feeders on the machine. The unspooling devices may operate in conjunction with stop motions sensors. For a Stoll ADF electronic knitting machine with thirty-two feeders, each feed may have an unspooling device designated to feed a material.

DETAILED DESCRIPTION

Reference will now be made in detail to the preferred embodiments of the present invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail so as not to unnecessarily obscure aspects of the embodiments of the present invention. The drawings showing embodiments of the invention are semi-diagrammatic and not to scale and, particularly, some of the dimensions are for the clarity of presentation and are shown exaggerated in the drawing Figures. Similarly, although the views in the drawings for the ease of description generally show similar orientations, this depiction in the Figures is arbitrary for the most part. Generally, the invention can be operated in any orientation.

In the embodiments described in greater detail herein, the unspooling devices are used for flat knitting and/or V-bed knitting, in which material strands are side fed or overhead fed. However, it will be appreciated that the present disclosure can be used on any type of textile machine.

Figure 11:
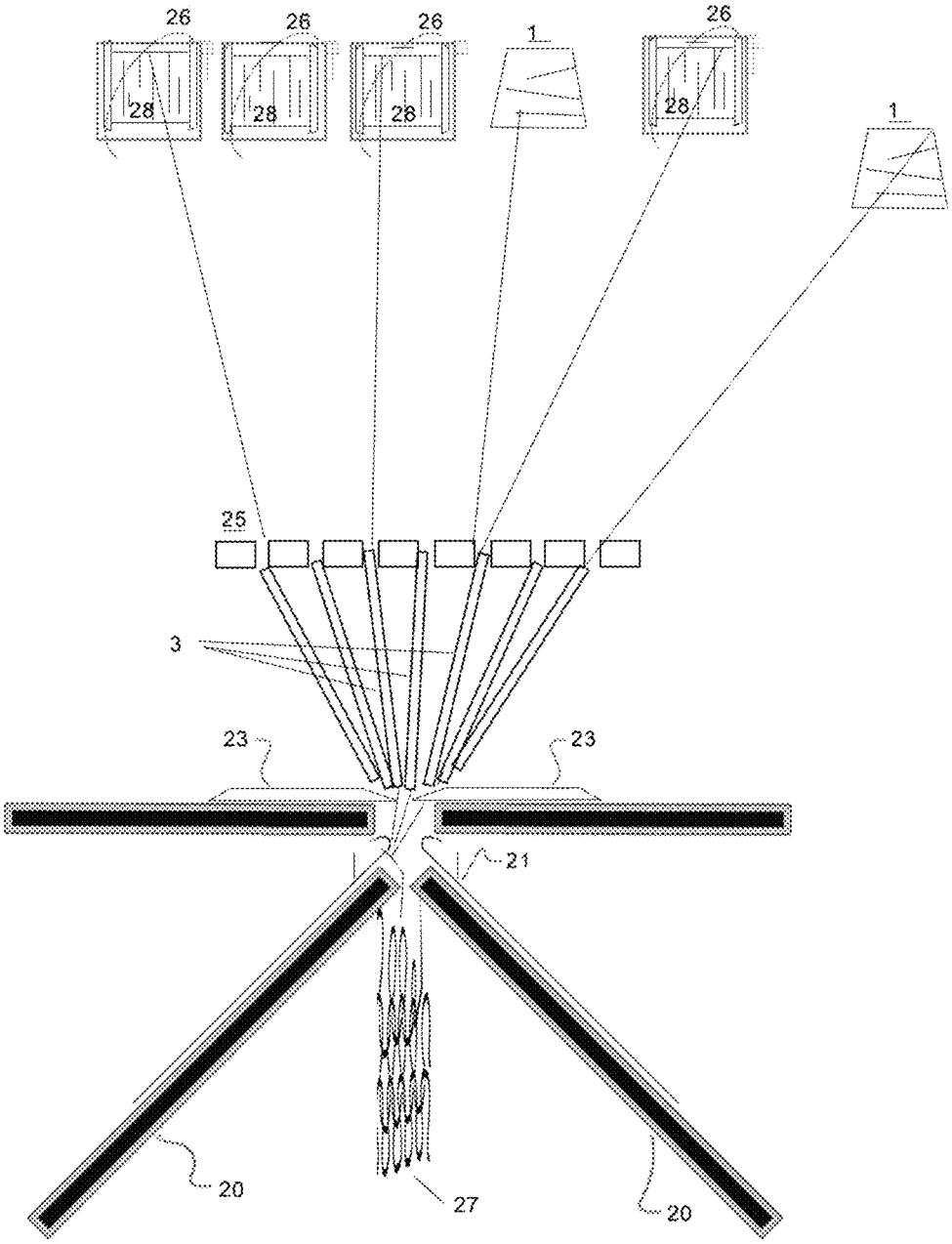
FIG. 11 illustrates a side view of a V-bed knitting machine with multiple unspooling devices mounted on top.
Figure 12:
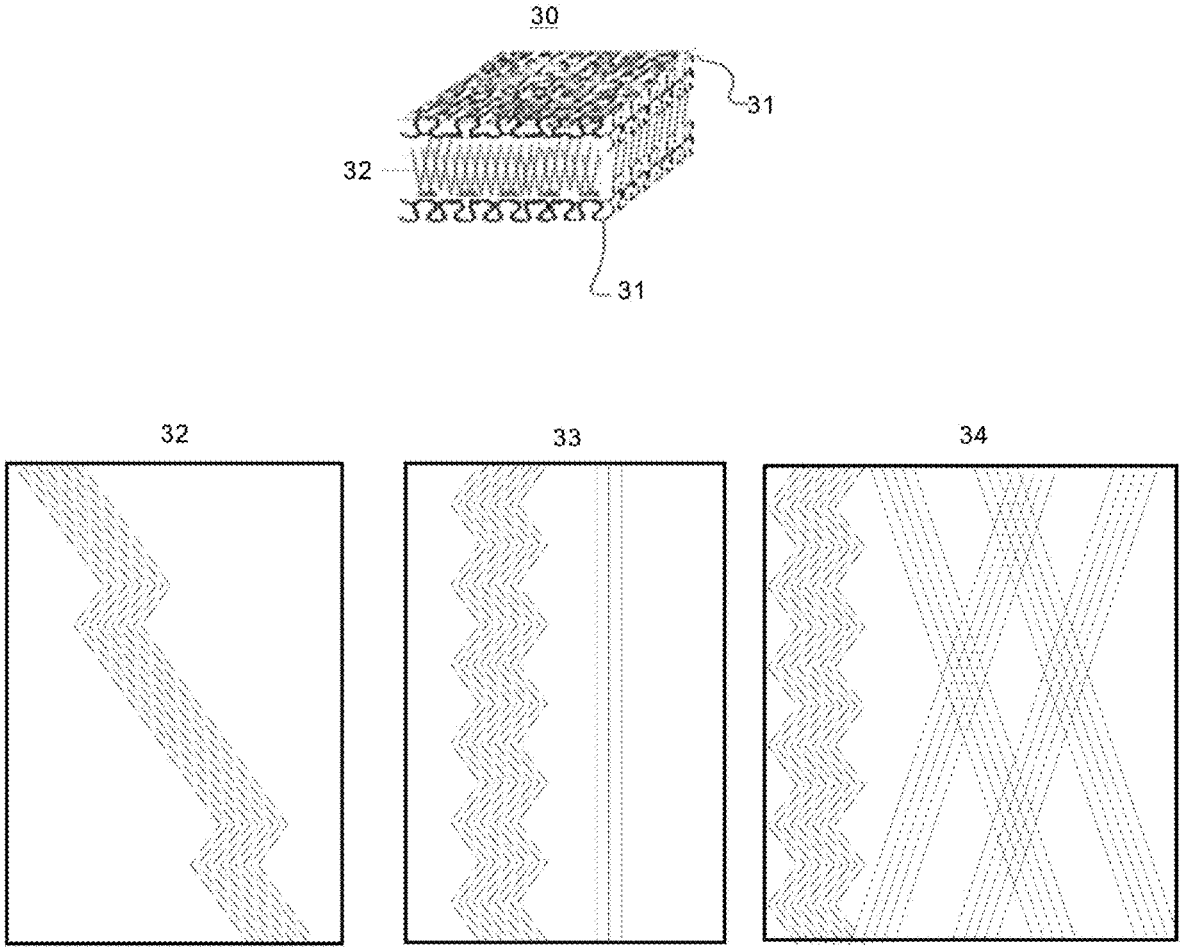
FIG. 12 illustrates a spacer fabric and warp structures.

FIG. 11 illustrates a knitting machine equipped with exemplary unspooling devices in accordance with an embodiment of the present disclosure. In the case of a yarn feeding system as shown in FIG. 1, the yarn comes over the top of the machine, through the stop motions 5, diagonally to the side of the machine and through the opening on the sides of the machine as in FIG. 1. The unspooling device or multiple devices can be mounted on a supporting rack on one or both sides of the machine, e.g., a side-feeding machine. There can be multiple unspooling devices mounted on supporting racks on both sides of the machine, passing material into the existing OEM openings in the side of the machine, and into the yarn feeders. By mounting the unspooling device and or devices on the sides, a material is caused to bend the least amount. When mounted on the side of the machine, the unspooling device may utilize the wiring of the side tensioning stop motion cable 14 as that pre-existing in the currently available knitting machines.

In the case of top feeding knitting machines, for example: Stoll CMS ADF and the Steiger Participations Aries 3130, the unspooling device offers multiple advantages over existing OEM unspooling systems, such as the Shima Seiki unspooling, and H. Stoll AG & CO. KG dancer unspooling device. For both the existing Shima Seiki unspooling device and the Stoll dancer device, an unspooling device is mounted on the floor, next to the knitting machine, taking up considerable space. Only two devices per machine may be used. The machine also runs considerably slower to accommodate both the Shima and Stoll devices on their respective machines, as both devices are customized to their respective brands of equipment.

Embodiments of the present disclosure, FIG. 11, allow multiple unspooling devices to be installed and simultaneously used on a knitting machine. Multiple devices may be used in a single feeder. An unspooling device can utilize the existing OEM stop motion wiring systems on a knitting machine and is not specific to any machines make or model. The unspooling device can fit into the existing floor space of a knitting machine when it is applied to an over-head feed model of machine. When applied to side feed machines, multiple unspooling devices can be located in the same space on either side or on both sides of the machines.

For example, regarding the Stoll ADF 32, aside from the separation feeder material in one (the first) reserved feeder, and the comb thread feeder as a second reserved feeder, the remaining feeders each may have an unspooling device attached. If on the machine, there is a modified standard feeder (e.g., with the crochet/warp pattern guide) containing a plurality of strands, the plurality of strands can be directed into one feeder device. Therefore, the plurality of unspooling devices operates to feed a single warp feed. Multiple modified standard feeders containing a plurality of strands, or multiple standard feeders, may be fed by a plurality of unspooling devices.

Figure 13:
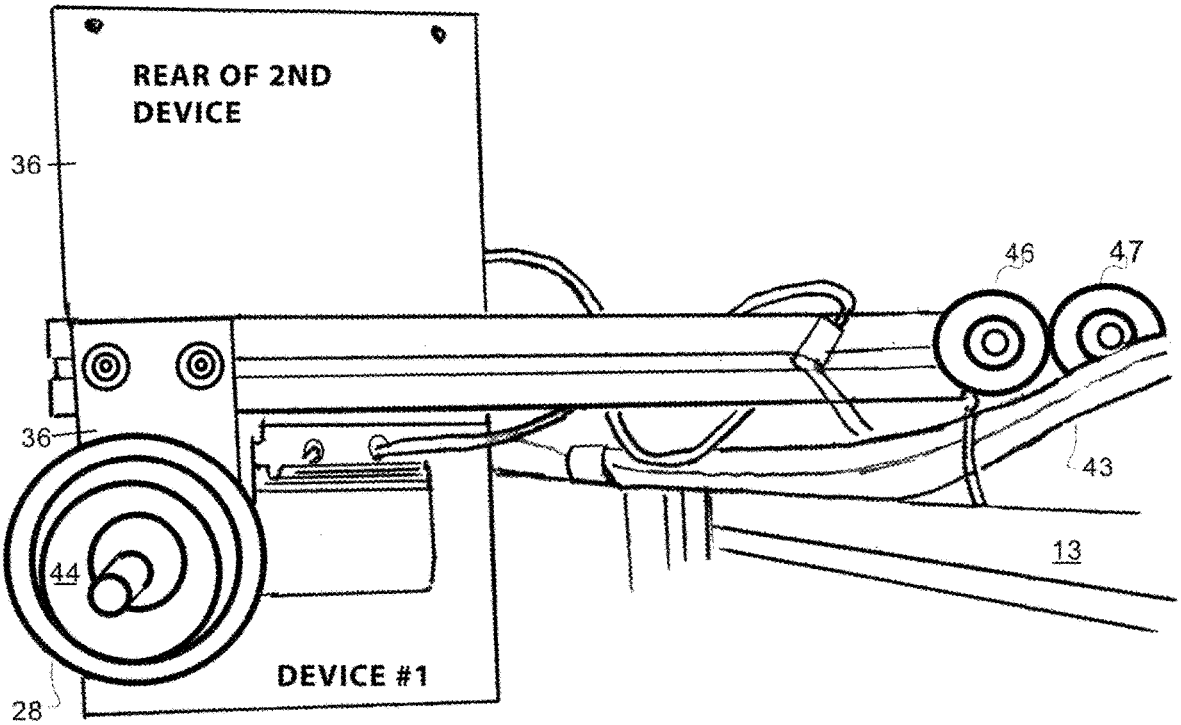
FIG. 13 illustrates the configuration of an unspooling motor housing component of an exemplary unspooling device in accordance with an embodiment of the present disclosure.
Figure 14:
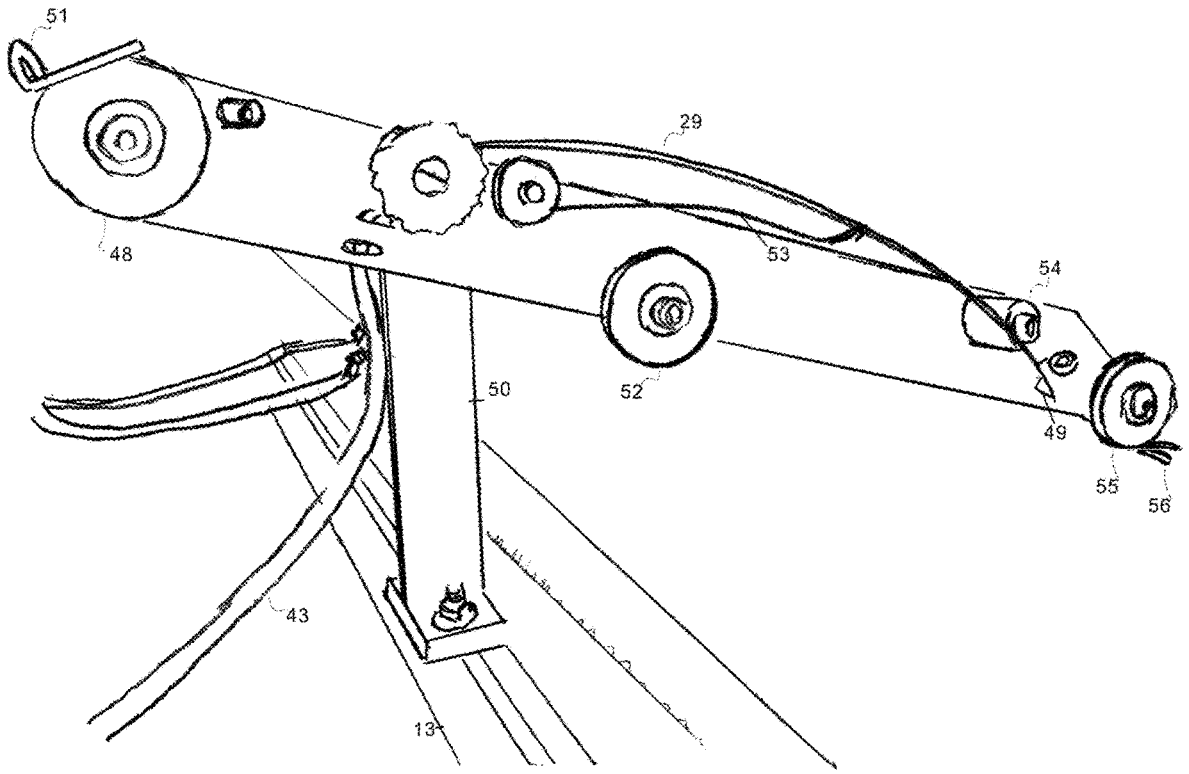
FIG. 14 illustrates the configuration of a stop motion assembly and the trigger arm section of an exemplary unspooling device in accordance with an embodiment of the present disclosure.

In some embodiments, an unwinding/unspooling device includes a means for automatically controlling the rate of deployment, which corresponds to the speed at which a material is withdrawn from the package. The unwinding device may include two components: a variable motor drive assembly (as shown by 36 in FIG. 13 and FIG. 15) and a roller guided stop motion assembly with a spring arm trigger sensor (29 in FIG. 14). FIG. 13 illustrates the configuration of an unspooling motor housing component of an exemplary unspooling device in accordance with an embodiment of the present disclosure. FIG. 14 illustrates the configuration of a stop motion assembly and the trigger arm section of an exemplary unspooling device in accordance with an embodiment of the present disclosure. The unspooling device may be installed on a knitting machine that has a similar configuration as shown in FIG. 1.

Figure 15:
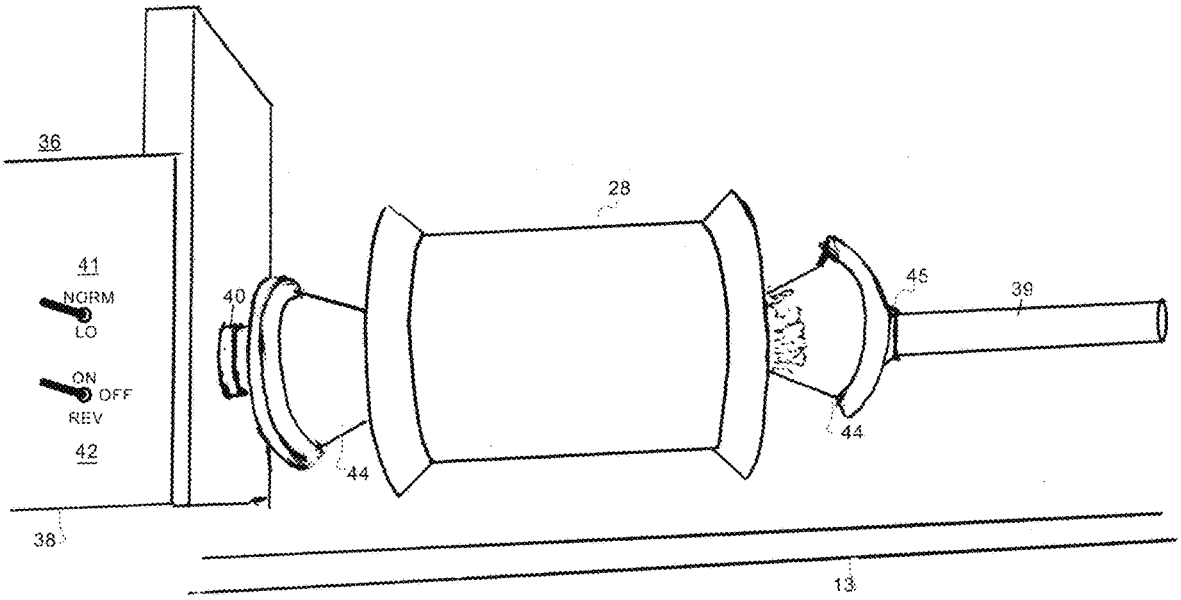
FIG. 15 illustrates a rear view of motor housing component segment of the exemplary unspooling device in accordance with an embodiment of the present disclosure.

In FIG. 15, the variable motor drive assembly 36 includes a motor housing assembly 38 with a mounting base 40, the motor assembly having a central rod axel or spindle shaft 39, which is driven by a driving element (not explicitly shown). For example the driving element is a gear mounted ninety degrees (perpendicular) to the linear actuator gear that is rotated by a variable motor drive (not explicitly shown). The gear may be mounted perpendicular to compress space required in transferring the motor movement from the variable motor drive element. The variable motor drive element has two speed selectors 41, low and normal mode, as well as a power on/off switch 42, which are wired to, and controlled by, a motion controller printed circuit board (PCB) inside the motor housing. The motor speed selections and the power switch 42 are wired to selector switches on the exterior motor housing. The PCB contains an integrated random operating memory (ROM) chip. As controlled by a custom run program stored in the chip, the chip generates control signals to engage the drive motion in coordination with the mechanical spring arm of the stop motion component of the unwinding system.

In some embodiments, the pre-existing wiring system of the knitting machine (as one that is commercially available) as previously described can be used to stop the knitting process by standard OEM stop motion devices. An exemplary unwinding/unspooling device may utilize the pre-existing OEM wiring system for the yarn storage system and the OEM stop motion devices to enable a plurality of units to be utilized on a machine. The unwinding/unspooling device may derive power from the pre-existing OEM wiring system for yarn storage system. Alternatively, a separate power supply and transformer may be added to the knitting machine assembly to power a series of unspooling devices.

In some embodiment, coordinated by the pre-programmed control circuits in a chip, the unwinding/unspooling device is operable to, in conjunction with the pre-existing OEM wiring system for the OEM stop motion devices, to deploy material, vary the speed at which the material is deployed from the spool 28, and stop the machine in case too much or too little material is deployed, for example, based on certain predefined minimum and maximum tension thresholds. The pre-existing OEM wiring system for OEM stop motion devices utilizes a mechanical spring arm to trigger the OEM device to stop the machine, as previously described. Particularly, when the spring arm of an OEM stop motion senses slack (or lack of adequate tension) in the material, the slack causes the arm to rise to approximately ninety degrees to close a circuit. The closed circuit in turn causes the machine to signal the machine controller to cease the knitting process.

The roller guided stop motion assembly with a spring arm trigger 29 is connected electronically by an electronic cable 43 to the PCB in the motor housing of the step motor drive assembly 36 and back to the machines stop motion system. For example, when the spring arm is in Position One, with the spring arm raised to approximately an angle of one o'clock, the step motor drive is signaled to slow deployment of material without stopping the machine. When the spring arm is in Position Three, with the spring arm lowered to approximately an angle of three o'clock, the step motor drive is signaled to expedite deployment of material, e.g., at the maximum speed, without stopping the machine. When the spring arm is in Position Ten, with the spring arm raised to approximately an angle of ten o'clock the stop motion system is activated, sensing a broken yarn or material deploying at too rapid a speed. When the spring arm is in Position Three, and remains at Position Three (three o'clock angle) for more than three seconds at the maximum speed, the unspooling device signals the stop motion system of the machine, which may stop the knitting process as controlled by the Arduino program. Thus, the deployment speed of the material is varied depending upon the angle of the spring arm. Should the spring arm be completely raised up (e.g., in an angle of twelve o'clock), the stop motion system is triggered, and the knitting process is stopped. The step motor drive can be implemented in any suitable manner that is well known in the art.

The central rod axel 39 can hold packages up to 10 inches (25 cm) in height, with a center core hole of a minimum of 1.5 cm. The diameter of the package and/or packaging flange has a minimum of the core hole of 1.5 cm, and the maximum can be 10 inches (25 cm) or more, depending on the mounting distance from the center rod axel to the rear stop motion rail on the knitting machine. A special rack may be installed to accommodate large diameter packages. The weight of the spool package may be in direct relationship to the size of the step motor. For instance, a 5.0 ampere motor can safely rotate a three-pound (1.5 kilogram) package on high speed of the device and deploy enough material for a flat knitting machine operating at 0.95 meters per second.

The central rod axel/spindle shaft 39 has two removable and repositionable cone shaped spool abutments 44. These abutments allow accommodation of multiple sized packages 28 with varying center core apertures, cylinder diameters, and flange sizes. The cone abutments each have a hollow center, with a screw pin 45 accessible from the outside that can be tightened to fix in place or be loosened in order to reposition or remove. These cone shaped abutments 44 fit snuggly on either side of the package holding it in place.

The package 28 is inserted onto the rod axel/spindle shaft 39 horizontally. The rod axel/spindle shaft can rotate clockwise and counter clockwise. On a top-feeding machine such as a Stoll ADF or a Steiger Aires Vesta Series V-bed knitting machine, this is parallel to the knitting machine's OEM stop motion bars 13, and parallel to the floor. On a side-feeding machine, the units are mounted on a rack to each side of the machine, and the rotation of the spools is parallel to the floor. There is one strand of filament or multi-filament material per unspooling device (one spool or package per device). However, the unspooling devices may be staked one on top of the other as in FIG. 13

While unwinding during the process of knitting, embroidering, braiding or crocheting, the material is drawn from the package, and the strand passes from the package and under one set of roller wheels 46 mounted on the motor housing segment and over a second pair of wheels 47 that are mounted on the roller guide stop motion assembly. These wheels align the material. The material then passes to the spring arm controlling component 29 which has roller guide wheels on the end and a pot eye or roller wheel on the end of the trigger arm, depending on the type of material being used, as shown in FIG. 14. The spring arm controlling component 29 includes a long arm with several guide wheels and a spring arm that is connected to the printed circuit board component of the motor housing portion of this device by an electronic wire cable. The motor housing also contains the variable motor and spindle shaft mount. The spring-arm controlling component with roller guide wheels is mounted at an angle and has a supporting post 50 that is mounted to the OEM stop motion bar 13 of the overhead feeding machine.

The material passes through a coated guide eye 51 and over another pair of roller wheels 47. The material then enters the spring arm assembly unit passing through a coated guide eye 51 and over a first set of roller wheels 48. It then passes under an additional roller wheel 52 located under the spring tension arm 29. This wheel serves to keep the material aligned and dimensionally controlled directly under the spring arm so that it flows at a desired angle. The spring arm 29 has a guide arm 53, as many vintage knitting machine stop motions have, including the Stoll Ajum. This guide arm is a standard support for a spring structure arm assisting the spring arm 29 to resist bending due to the stiff nature of the materials being deployed. This spring arm support guide arm 53 slides on the spring arm as it bobs up and down deploying material. The tip of the spring arm 29 has a coated pot eye 49, shown in FIG. 14 perched in rest position under a long roller wheel 54. This wheel is positioned for two purposes: 1) to rest the spring arm when not in use, as shown; 2) to give the spring arm a minimum angle while deploying material. The spring arm should not go lower than this long roller wheel 54 or the material will not deploy properly into the machine's yarn feeder system. The material is threaded through the spring arm pot eye 49 and glides over a last roller wheel 55 and a coated eye 56 located at the very end of the stop motion roller guide assembly.

In some embodiments, with very stiff material, the pot eye at the end of the spring arm may be removed and a set of rollers are put in its place. Specific types of materials may require special care. The roller wheel may be of various materials to insure the strand feed properly with the least amount of drag and friction. Alternate materials such as polypropylene, ceramic, titanium coatings may be applied to the wheels guides, dependent upon the material properties of the strands being deployed.

Figure 16:
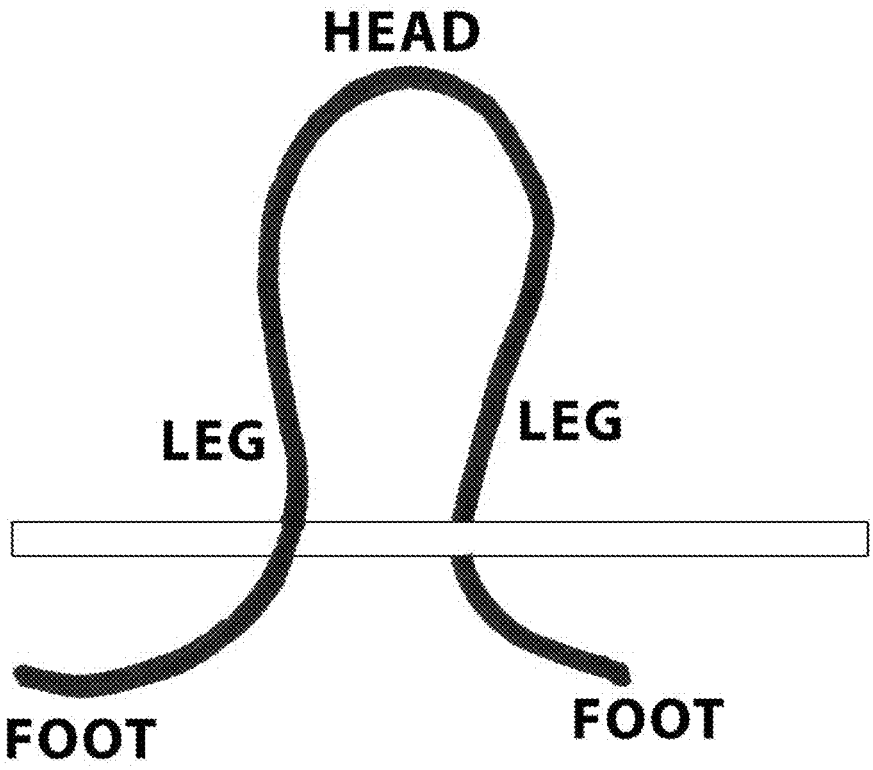
FIG. 16 illustrates parts of a knit loop with inlay.

In some embodiments, the unspooling device may be used for embedding thermally conductive material, thermo coupling cables, shielded wires and other elements which might be utilized for heating elements. The material may be unspooled and inlaid and or knitted, if inlaid, passed between the legs of loop structures of a knitted structure such as, a jersey, double bed structure, spacer 30; passed inside a tunnel, a channel, or a three-dimensional raised structure, or embedded into a structure with a series of knit loops, tucking loops, missed loops, or transfers. The unspooled material may be guided horizontally, vertically, or diagonally, or any combination of directions on an X, Y, Z directional plane grid. The knitted construction may have a single layer or a multiple layer configuration. The material would be incorporated consistently, and the integration repeated automatically in production with controlled deployment of speed and tension into the machine's yarn feed system. FIG. 16 illustrates parts of a knit loop with inlay.

In some embodiments, the unspooling device may be used for embedding a data transmitting cable, which might be utilized for smart textile and or e-textile elements, etc. The material would be unspooled and inlaid and or knitted, if inlaid, passed between the legs of loop structures of a knitted structure. The knitted structure may be a jersey, double bed, spacer, may be passed inside a tunnel, channel, or a three-dimensional raised structure, or may be embedded into a structure with a series of knit loops, tucking loops, missed loops, or transfers. The unspooled material may be guided horizontally, vertically, or diagonally, or any combination of directions on an X, Y, Z directional plane grid. The knitted construction may have a single layer or a multiple layer configuration. The material would be incorporated consistently, and the integration repeated automatically in production with controlled deployment of speed and tension into the machine's yarn feed system.

In some embodiments, the unspooling device may be used for embedding an energy transmitting wire or power cord, which might be utilized for smart textile wiring connected to devices such as sensors and or e-textile elements requiring connectors. The material would be unspooled and inlaid and or knitted, if inlaid, passed between the legs of loop structures of a knitted structure such as, a jersey, double bed, spacer; passed inside a tunnel, channel, or three-dimensional raised structure; or embedded into a structure with a series of knit loops, tucking loops, missed loops, or transfers. The unspooled material may be guided horizontally, vertically, or diagonally, or any combination of directions on an X, Y, Z directional plane grid. The knitted construction may have a single layer or a multiple layer configuration. The construction may also have fully-shaped appendage elements and/or liner areas receiving the unspooled materials, where the entire construction and or component is completely fashioned to shape by the machines, with no cutting, no sewing, and no trimming of the component or component layers. There is no need for a separate sub-assembly process or sewing application. The material would be incorporated consistently, and the integration repeated automatically in production with controlled deployment of speed and tension into the machine's yarn feed system.

In some embodiments, the unspooling device may be used for integration of shape changing and/or shape memory wire, such as NiTinol (nickel titanium alloy) or other performance alloys, which might be utilized for transformation textile applications. The material would be unspooled and inlaid and or knitted, if inlaid, passed between the legs of loop structures of a knitted structure such as, a jersey, double bed, spacer; passed inside a tunnel, channel, or three-dimensional raised structure; or embedded into a structure with a series of knit loops, tucking loops, missed loops, or transfers. The unspooled material may be guided horizontally, vertically, or diagonally, or any combination of directions on an X, Y, Z directional plane grid. The knitted construction may have a single layer or a multiple layer configuration. The construction may also have fully-shaped appendage elements and/or liner areas receiving the unspooled materials, where the entire construction and/or component is completely fashioned to shape by the machines, with no cutting, and no sewing of the component or component layers. There is no need for a separate sub-assembly process or sewing application. The material would be incorporated consistently, and the integration repeated automatically in production with controlled deployment of speed and tension into the machine's yarn feed system.

In some embodiments the unspooling device may be used for creating stretch ligaments in knitted textile applications, utilizing materials such as silicon, Dupont's Hytrel, Elastane, Dupont's Lycra, Natural or synthetic rubber, stretch olefin, silicon extructions, auxetic materials, or other materials with stretch and recovery properties. The material would be unspooled and inlaid, passed between the legs of loop structures of a knitted structure such as, a jersey, double bed, spacer; passed inside a tunnel, channel, or three-dimensional raised structure; or embedded into a structure with a series of knit loops, tucking loops, missed loops, or transfers. The unspooled material may be guided horizontally, vertically, or diagonally, or any combination of directions on an X, Y, Z directional plane grid. The knitted construction may have a single layer or a multiple layer configuration. The construction may also have fully-shaped appendage elements and/or liner areas receiving the unspooled materials, where the entire construction and or component is completely fashioned to shape by the machines, with no cutting, no sewing, and no trimming of the component or component layers. There is no need for a separate sub-assembly process or sewing application. The material would be incorporated consistently, and the integration repeated automatically in production with controlled deployment of speed and tension into the machine's yarn feed system.

In some embodiments, the unspooling device may be used for creating high tenacity ligaments in knitted textile applications, utilizing materials such as Dyneema, Kevlar, ultra high molecular polyurethane (UHMWPE), fiber glass, carbon fiber, hemp, linen, flax, resin pre-impregnated materials, monofilaments, multi-filaments or other materials which limit stretch and or provide reinforcing properties. The material would be unspooled and inlaid, passed between the legs of loop structures of a knitted structure such as, a jersey, double bed, spacer; passed inside a tunnel, channel, or three-dimensional raised structure; or embedded into a structure with a series of knit loops, tucking loops, missed loops, or transfers. The unspooled material may be guided horizontally, vertically, or diagonally, or any combination of directions on an X, Y, Z directional plane grid. The knitted construction may have a single layer or a multiple layer configuration. The construction may also have fully-shaped appendage elements and/or liner areas receiving the unspooled materials, where the entire construction and or component is completely fashioned to shape by the machines, with no cutting, no sewing, and no trimming of the component or component layers. There is no need for a separate sub-assembly process or sewing application. The material would be incorporated consistently, and the integration repeated automatically in production with controlled deployment of speed and tension into the machine's yarn feed system.

With the existing stock machine software and motions of the standard machine feeder system raising, lowering, and lateral actions one or more feeders may introduce a plurality of strands to inlay, move between the already made loops, in a designated and constant knitting system of the cam box.

Embodiments of the present disclosure offer several advantages. First, the device enables a controlled unspooling process in a compressed amount of space. In most cases the controlled unspooling process can implemented by using the existing floor space of the textile machine and utilizing the existing OEM stop motion wiring systems. Second, the unspooling device can be used to deploy variously sized and configured spools, which may be pre-wound under equally various tensions, to be knitted consistently into the same knitted fabric, a component or a three-dimensional textile construction. Third, the unspooling device allows a plurality of devices to be mounted on a single machine and used in a single knitted structure. Fourth, the unspooling device allows integration of many materials that would otherwise require additional sub-assembly, as in the case of embedded wiring, fiber optics, silicon, ligament structures. Fifth, the unspooling device is suitable for deployment and integration of fiber reinforcing materials, including resin pre-impregnated materials, and combinations of materials in the same knitted panel, a knitted component, or a three-dimensional textile configuration. Sixth, the unspooling device enables dynamic adjustment of the yarn deployment speed based on the tension that is sensed in real time. Thereby, the yarn deployment speed and so the amount of the yarn used in the knitting process can be precisely controlled, advantageously preventing interruption of the process and preventing creation of defects in the resultant knitting fabric.

Although certain preferred embodiments and methods have been disclosed herein, it will be apparent from the foregoing disclosure to those skilled in the art that variations and modifications of such embodiments and methods may be made without departing from the spirit and scope of the invention. It is intended that the invention shall be limited only to the extent required by the appended claims and the rules and principles of applicable law.

What is claimed is:

1. An unspooling assembly capable of tensioned dispensing of a material to a textile machine during a fabric making process, wherein the material is unwound without torque, the unspooling assembly comprising:

a variable motor drive assembly comprising:

a motor coupled to a material package and to rotate the material package at a variable speed in coordination with the textile machine during the fabric making process;

a variable motor drive coupled to the motor to drive the motor: in a first rotational direction at a plurality of speeds in order to reduce tension on the dispensed material; and in a second rotational direction that is opposite from the first rotational direction in order to increase tension on the dispensed material;

a roller guided stop motion assembly comprising: roller guides for guiding the material; a spring arm trigger sensor; and a spring arm and arm guide, wherein the spring arm trigger sensor:

signals various tensions of the material during rotation of the motor by repositioning the spring arm and arm guide to one of a plurality of discrete positions that each correspond to a tension of the material; and a controller electronically coupled to the variable motor drive and the roller guided stop motion assembly to:

receive a first signal from the roller guided stop motion assembly, wherein the first signal is indicative of the position of the spring arm and arm guide; and generate a second signal for supply to the variable motor drive in response to receipt of the first signal indicative of the position of the spring arm and the arm guide, wherein the second signal indicates a selected speed of the plurality of speeds as well as either the first rotational direction or the second rotational direction;

wherein the variable motor drive, in response to the second signal, adjusts the motor to the selected speed to rotate the material package so that deployment of the material is varied depending upon the position of the spring arm.

2. The unspooling assembly of claim 1, wherein the controller comprises an integrated circuit storing an executable program configured to control the variable motor drive.

3. The unspooling assembly of claim 1, wherein variable motor drive assembly further comprises:

a housing configured to contain the motor and comprising a mounting base, wherein the motor comprises a central rod axle or spindle shaft which is driven by a driving element; and wherein the motor comprises speed selectors as well as a power on/off switch which are wired to, and controlled by, a motion controller printed circuit board.

4. The unspooling assembly of claim 1, wherein the motor is configured to rotate an actuator element, and wherein the material package is rotated in correlation to the actuator element being driven by the motor.

5. The unspooling assembly of claim 1, wherein the material package with the material wound thereon is coupled to the unspooling assembly on an axle/spindle shaft, and wherein the axle/spindle shaft can rotate clockwise and counterclockwise, thereby unspooling the material in coordination with movement of the textile machine.

6. The unspooling assembly of claim 1, wherein the material package comprises a cylindrical barrel bounded by flanges located adjacent to each end of the cylindrical barrel.

7. The unspooling assembly of claim 1, wherein the material comprises at least one of: a resin pre-impregnated composite material; a wire material; a fiber optic material; a polymer reinforcing fiber material; and/or a multiple strand material.

8. The unspooling assembly of claim 1, wherein the roller guided stop motion assembly further comprises a stop motion unit, wherein the stop motion unit is configured to simultaneously stop the textile machine movement and the motor drive assembly in response to the spring arm and the arm guide being repositioned to a designated angle where the spring arm reaching that designated angle causes touching of a contact point that sends a signal to the controller which in turn stops the textile machine and the deployment of the material.

9. A system operable to incorporate materials into textile constructions, the system comprising:

an unspooling assembly capable of tensioned dispensing of a material at a plurality of speeds without applying torque to the material itself, the unspooling assembly comprising:

a variable motor drive assembly comprising:

a motor coupled to a material package and to rotate the material package to deploy the material at a speed in coordination to movements of a textile machine;

a variable motor drive coupled to the motor and configured to drive the motor in a first rotational direction at a plurality of speeds in order to reduce tension on the dispensed material and in a second rotational direction that differs from the first rotational direction in order to increase tension on the dispensed material;

a roller guided stop motion assembly comprising: roller guides for guiding the material; a spring arm trigger sensor; and a spring arm and arm guide, wherein the spring arm trigger sensor:

signals various tensions of the material during rotation of the motor by sensing a repositioning of the spring arm and the arm guide to one of a plurality of discrete positions on an arc that each correspond to a tension of the material; and a controller electronically coupled to the variable motor drive and the roller guided stop motion assembly to:

receive a first signal from the roller guided stop motion assembly, wherein the first signal is indicative of the position of the spring arm and the arm guide; and generate a second signal for supply to the variable motor drive in response to receipt of the first signal indicative of the position of the spring arm and the arm guide, wherein the second signal indicates a selected speed of the plurality of speeds as well as either the first rotational direction or the second rotational direction;

wherein the variable motor drive, in response to the second signal, adjusts the motor to the selected speed to rotate the material package so that deployment speed of the material is varied depending upon the position of the spring arm.

10. The system of claim 9 further comprising:

a processor; and a memory storing instructions of a program that, when executed by the processor, implements a change in rotation of the motor driving the rotation of the material package and deployment of the material.

11. The system of claim 9, wherein the controller comprises an integrated circuit storing an executable program configured to control the variable motor drive.

12. The system of claim 9, wherein the variable motor drive assembly further comprises:

a housing configured to contain the motor and comprising a mounting base, wherein the motor comprises a central rod axle or spindle shaft which is driven by a driving element; and wherein the motor comprises speed selectors as well as a power on/off switch which are wired to, and controlled by, a motion controller printed circuit board.

13. The system of claim 9, wherein the motor is orientated at an angle to an actuator element, and wherein the motor is configured to rotate the actuator element.

14. The system of claim 9, wherein the material package with the material thereon is coupled to the unspooling assembly on an axle/spindle shaft, and wherein the axle/spindle shaft can rotate clockwise, and counterclockwise in coordination with movements of a textile machine.

15. The system of claim 9, wherein the material package comprises a cylindrical barrel bounded by flanges located adjacent to each end of the cylindrical barrel.

16. A method of dispensing a material wound on a material package to a textile machine without adding torque to the material wound on the material package, and varying speed at which the material is dispensed during a fabric construction process, the method comprising:

constructing the material into a textile on the textile machine by feeding the material from the material package and rotating the material package;

rotating the material package at a first speed in a first rotational direction by using a variable motor assembly coupled to the material package in order to reduce tension on the dispensed material;

rotating the material package in a second rotational direction that is opposite from the first rotational direction by using the variable motor assembly coupled to the material package in order to increase tension on the dispensed material;

where speed of the material deployed from the material package is sensed by positioning of a spring arm and arm guide on a roller guided stop motion assembly;

where the positioning of the spring arm and the arm guide is located at a first position on an arc, where an angle of the arc is based on the first speed of the material being fed through wheel rollers and the spring arm and the arm guide on the roller guided stop motion assembly, where the roller guided stop motion assembly senses the positioning of the spring arm and the arm guide at the first position on the arc based on the first speed;

generating a first signal from the roller guided stop motion assembly and sending the first signal to a motor assembly of the textile machine based on the first position of the spring arm and the arm guide;

in response to the first signal, rotating the material package at the first speed by using the variable motor assembly coupled to the material package;

sensing a repositioning of the spring arm and the arm guide at a second position based on a speed of deployment for the material and generating a second signal to control the variable motor assembly to rotate the material package at a second speed that differs from the first speed so that the speed of deployment of the material is varied depending upon the position of the spring arm without stopping the fabric construction process.

17. The method of claim 16, further comprising orienting a motor in the variable motor assembly drives an actuator element, and wherein the material package is rotated in correlation to the actuator element driven by the motor.

18. The method of claim 16, further comprising positioning the material package on an axle/spindle shaft; and rotating the axle/spindle shaft on the motor assembly clockwise, and counterclockwise in coordination with movements of the textile machine.

19. The method of claim 16, further comprising using the material package, wherein the material package comprises a cylindrical barrel bounded by flanges that are located adjacent to each end of the cylindrical barrel.

20. The method of claim 16, further comprising:

using a pot eye with the textile machine for a first type of dispensed material;

swapping the pot eye with a set of rollers with the textile machine for a second type of dispensed material; and selecting a material type for the set of rollers dependent upon properties of the second type of material being dispensed.

21. The method of claim 16 further comprising:

detecting a tension that is greater or lesser than a predefined maximum and minimum threshold tension at the spring arm and the arm guide; and responsive to the detecting of a repositioning of the spring arm and the arm guide to a predefined maximum or minimum position on an arc, stopping the variable motor assembly from the rotating of the material package, stopping the deployment of the material, and stopping the textile machine.

* * * * *